US005644931A

United States Patent [19]

Ueno et al.

[11] Patent Number: 5,644,931

[45] Date of Patent: Jul. 8, 1997

[54] GAS LIQUEFYING METHOD AND HEAT EXCHANGER USED IN GAS LIQUEFYING METHOD

[75] Inventors: Koichi Ueno; Kenichiro Mitsuhashi, both of Takasago, Japan

[73] Assignee: Kabushiki Kaisha Kobe Seiko Sho, Kobe, Japan

[21] Appl. No.: 569,901

[22] Filed: Dec. 8, 1995

[30] Foreign Application Priority Data

Dec. 9, 1994 [JP] Japan ..... 6-331942
Dec. 9, 1994 [JP] Japan ..... 6-331943

[51] Int. Cl.[6] ..... F25J 3/00

[52] U.S. Cl. ..... 62/612; 62/623; 62/903

[58] Field of Search ..... 62/612, 903, 623

[56] References Cited

U.S. PATENT DOCUMENTS

| | | | |
|---|---|---|---|
| 4,141,707 | 2/1979 | Springmann | 62/612 X |
| 4,330,308 | 5/1982 | Grenier et al. . | |
| 4,496,382 | 1/1985 | Geist et al. | 62/623 |
| 4,592,767 | 6/1986 | Pahade et al. | 62/623 |
| 4,987,744 | 1/1991 | Handley et al. | 62/623 |
| 5,329,774 | 7/1994 | Tanguay et al. | 62/612 |
| 5,385,203 | 1/1995 | Mitsuhashi et al. | 165/110 |

FOREIGN PATENT DOCUMENTS

| | | |
|---|---|---|
| 47-29712 | 8/1972 | Japan . |
| 61-55024 | 11/1986 | Japan . |

*Primary Examiner*—Christopher Kilner
*Attorney, Agent, or Firm*—Oblon, Spivak, McClelland, Maier & Neustadt, P.C.

[57] ABSTRACT

This invention relates to a gas liquefying method in which a power saving of a compressor for refrigerant can be attained. The pre-cooled gas flow, the high pressure vapor flow and the high pressure condenced liquid flow obtained by gas-liquid separation of partial condensed high pressure multi-component refrigerant are fed from the upper part of the high temperature region of the upright plate-fin type heat exchanger having its upper side applied as the high temperature region and its lower side applied as the low temperature region so as to be cooled, the cooled gas flow and the high pressure vapor flow are fed from the upper part of the low temperature region into the different flow passages so as to be cooled there, the liquefied gas is recovered from the lower part of the low temperature region, the vapor part and the liquid part obtained by expanding the liquefied high pressure vapor flow extracted from the lower part of the low temperature region are separated into gas and liquid, thereafter they are mixed to each other, fed from the lower part of the different flow passage in the low temperature region, used as the source of cold heat, then the mixture is extracted from the upper part of the low temperature region, mixed with a flow obtained by expanding the high pressure condensed liquid flow of the multi-component refrigerant passed through the high temperature region and further the mixture is divided into gas and liquid, the vapor part and the liquid part are mixed to each other, fed from the lower part of the different flow passage in the high temperature region and used as a source of cold heat, and extracted from the upper part of the high temperature region, compressed and cooled and further it is circulated as the partial condensed high pressure multi-component refrigerant.

9 Claims, 11 Drawing Sheets

GAS LIQUEFYING METHOD AND HEAT EXCHANGER USED IN GAS LIQUEFYING METHOD

BACKGROUND OF THE INVENTION

1. Field of the Invention

This invention relates to a gas liquefying method, and more particularly a method for liquefying gas containing at least one kind of component of low boiling point, natural gas, for example.

2. Description of the Related Art

As a method for liquefying natural gas, a gazette of Japanese Patent Publication No. Sho 47-29712, for example, discloses a liquefying method in which a methane enriched gas feeding flow is heat exchanged in sequence with a refrigerant of single component under a condition of low temperature so as to be pre-cooled, in turn a condensed part and a vapor part of the refrigerant having multi-components pre-cooled until the part is condensed through a heat exchanging operation with the aforesaid single component refrigerant are separated from each other, in the first stage the aforesaid condensed part is further cooled and expanded, thereafter it is heat exchanged with the aforesaid pre-cooled feeding flow and passed, and in the second stage the aforesaid vapour part is liquefied and expanded, thereafter it is heat exchanged with the aforesaid feeding flow and passed. Referring now to FIG. 5, a main exchanger which acts as its major segment will be described, wherein a heat exchanger 100 has its lower segment acting as the first stage (a high temperature region) 101 and its upper segment acting as the second stage (a low temperature region) 102. After the gas feeding flow is pre-cooled with the single component refrigerant, it is further cooled with the aforesaid single component refrigerant, thereby the pre-cooled gas flow 78 after the condensed component having a high boiling point is removed is fed from the lower part of the flow passage A arranged at the high temperature region 101, in turn, both a high pressure vapour stream (vapour part) 58 and a high pressure condensed liquid flow (a condensed part) 59 in which the multi-component refrigerant partially condensed through a heat exchanging with the single component refrigerant is separated into gas and liquid are also fed into each of the lower segments of the flow passage B and the flow passage C arranged at the high temperature region 101. The high pressure condensed liquid flow 59 of the multi-component refrigerant is further cooled while ascending in the flow passage C in the high temperature region 101, thereafter the liquid passes through an expansion valve 103, is sprayed from a spray nozzle 105 into the high temperature region 101 so as to cool fluids in the flow passages A, B and C. The high pressure vapour flow 58 of the multi-component refrigerant flowing in the flow passage B is cooled there and liquefied, thereafter fed into the flow passage F in the low temperature region 102, and further cooled there and then the flow passes through the expansion valve 104, sprayed from the spray nozzle 106 into the low temperature region 102 so as to cool the fluid in the flow passages E, F. The gas flow 78 flowed in the flow passage A in the high temperature region and cooled therein is fed into the flow passage E in the low temperature region 102, further cooled there, extracted as liquefied gas 60 and recovered as a product. The high pressure condensed liquid flow 59 of the multi-component refrigerant and the high pressure vapour flow 58 of the liquefied multi-component refrigerant sprayed from each of the spray nozzles 105, 106 are completely gasified through a heat exchanging operation with the fluid flowing in the flow passages A, B, C and the flow passages E, F, the gasified multi-component refrigerant vapour flow 68 is compressed by a compressor, thereafter it is heat exchanged with the single component refrigerant at the heat exchanger, circulated and used as the partial condensed multi-component refrigerant (not shown). In this method, a Hampson type heat exchanger is employed as a heat exchanger for the pre-cooled gas feeding flow and the multi-component refrigerant. This Hampson type heat exchanger has a disadvantage that a long flow passage of the heat exchanger is required and a high pressure loss is also resulted due to its manufacturing process in which an aluminum tube is wound around a core pipe in many turns, so that a high compressor horse power for this operation is required and so the heat exchanger by itself becomes large in its size due to the aforesaid structure. In addition, since the low temperature end of the low temperature fluid is present at the top part of the heat exchanger, the refrigerant liquid at the low temperature end is flowed reversely toward the high temperature end by its gravity in the case that the flow of fluid within the heat exchanger is stopped, a heat exchanging operation is carried out between the refrigerant liquid and the high temperature refrigerant vapour accumulated at the bottom part of the heat exchanger so as to cause a rapid boiling of the low temperature liquid to be generated and so it has still a problem in view of its safety.

A gazette of Japanese Patent Publication No. Sho 54-40764 discloses a method for liquefying natural gas in which the refrigerant containing multi-component is not pre-cooled with the single component, but cooled until it is partially condensed through a heat exchanging operation with cooling water, the condensed part and the vapor part of the refrigerant containing pre-cooled multi-components are separated and then the separated condensed part and vapour part are mixed again and fed into an inlet port of the plate-fin type heat exchanger, and further it is flowed in parallel with a flow of cooled component, natural gas, for example, and flowed in opposition to the flow of low temperature refrigerant after the high temperature refrigerant containing mixed condensed part and vapour part is cooled and expanded. Since this method is carried out in such a way that the condensed part and the vapour part of the refrigerant containing multi-components are mixed to each other at the inlet port of the heat exchanger, passed within the heat exchanger as mixed phase and not only the vapour part but also the condensed part are super-cooled down to the temperature in the low temperature region, its heat exchanging amount is increased more and a large-sized heat exchanger is required as compared with that of the method disclosed in the gazette of Japanese Patent Publication No. Sho 47-29712 in which the condensed part is not required to be super-cooled to the temperature of the low temperature region. In addition, since the condensed part contains a large amount of high boiling point components, a temperature difference between a condensing curve for the fluid to be cooled and an evaporating curve for the refrigerant may produce a certain clearance at the high temperature region where the evaporating latent heat of the high boiling point component is utilized to influence efficiently against a design of the heat exchanger, although at the low temperature region where the condensed part is super-cooled, only sensitive heat of the high boiling point component in the refrigerant is utilized, resulting in that it is hard to get a wide clearance at a temperature difference between the condensing curve for the fluid to be cooled and the evaporating curve for the refrigerant and so this process can not be defined as an effective utilization of heat of the refrigerant. Due to this fact, this method has some disadvantages that it requires a higher compressor horse power as compared with that of the aforesaid prior art and an energy consumption is increased.

SUMMARY OF THE INVENTION

It is a main object of the present invention to provide a gas liquefying method in which an energy saving can be promoted by reduction of compressor horse power by using a plate-fin type heat exchanger in the case that gas heat exchanged with the single component refrigerant under a condition of low temperature in sequence and pre-cooled is heat exchanged with the high pressure multi component refrigerant which is pre-cooled until a part of the refrigerant is condensed through the heat exchanging operation with the aforesaid single component refrigerant so as to liquefy gas.

In addition, it is another object of the present invention to prevent the refrigerant liquid at the low temperature end from being flowed reversely when the flow of fluid is stopped within the heat exchanger, to prevent a heat exchanging from being produced between the low temperature refrigerant liquid and the high temperature refrigerant vapour at the high temperature end of the heat exchanger and to prevent a rapid boiling of low temperature liquid from being produced.

The gas liquefying method of the present invention which is carried out by a plate-fin type heat exchanger having a high temperature region having at least four kinds of flow passages at the upper side mounted in such a way that the plate surface may be stood upright and a low temperature region having at least three kinds of flow passages at the lower side is comprised of the following steps of;

separating the high pressure multi-component refrigerant partially condensed through a heat exchanging with the single component refrigerant into the high pressure vapour flow and the high pressure condensed liquid flow;

separating the vapor and liquid of the aforesaid high pressure vapour flow liquefied, extracted from the lower part of the low temperature region and got through expansion, mixing the separated vapour part with the liquid part to obtain the second low pressure multi-component refrigerant flow;

mixing the second low pressure multi-component refrigerant flow extracted from the upper part of the aforesaid low temperature region with the flow got through expansion of the high pressure condensed liquid flow of the multi-component refrigerant after passing through the high temperature region, separating the above mixture into the vapor and liquid, mixing again the separated vapour part and condensed part to get the first low pressure multi-component refrigerant flow;

compressing the first low pressure multi-component refrigerant flow extracted as vapour from the upper part of the aforesaid high temperature region so as to get the aforesaid partial condensed high pressure multi-component refrigerant;

feeding each of the gas flow, the high pressure vapour flow of the multi-component refrigerant and the high pressure condensed liquid flow of the multi-component refrigerant from the upper parts of three kinds of flow passages in the flow passages in the aforesaid high temperature region, feeding the first low pressure multi-component refrigerant flow from the lower part of one kind of flow passage in the passages of the aforesaid high temperature region, heat exchanging the gas flow, the high pressure vapour flow of the multi-component refrigerant and the high pressure condensed liquid flow of the multi-component refrigerant with the first low pressure multi-component refrigerant flow so as to cool them;

feeding each of the gas flow cooled at the aforesaid high temperature region and the high pressure vapour flow of the multi-component refrigerant from each of the two kinds of flow passages in the flow passages of the aforesaid low temperature region, feeding the second low pressure multi-component refrigerant flow from the lower part of one kind of flow passage in the flow passages of the low temperature region, and heat exchanging the gas flow and the high pressure vapour flow of the multi-component refrigerant with the second low pressure multi-component refrigerant flow so as to perform a further cooling operation; and extracting the liquefied gas flow from the lower part of the aforesaid low temperature region and recovering it.

In this preferred gas liquefying method, the plate-fin type heat exchanger is used, so that it is possible to make a short linear flow passage within the heat exchanger and further to reduce a pressure loss. In addition, since the fluid to be cooled flows from the upper part of the heat exchanger to the lower part of it, the fluid to be cooled within the flow passage is partially condensed in the midway part of the flow passage to become liquid. This partial condensed liquid may generate a high static pressure so as to eliminate the pressure loss. As the pressure loss is reduced under these actions, the temperature difference between the condensing curve for the fluid to be cooled and the evaporating curve for the cooling fluid are directed larger so that it is possible to increase a heat exchanging rate per unit volume. Accordingly, the compressor horse power can be reduced and an energy saving can be attained. In addition, since the low temperature end of the refrigerant fluid is located at the lower part of the heat exchanger, the refrigerant fluid is flowed toward the low temperature end by its own gravity even if the flow in the heat exchanger is stopped, so that no reverse flow is produced at the low temperature end, resulting in that a safe operation can be carried out.

BRIEF DESCRIPTION OF THE DRAWINGS

FIG. 1(*b*) is a front elevational view for showing one preferred embodiment of the heat exchanger of the present invention.

DETAILED DESCRIPTION OF THE PREFERRED EMBODIMENT

Referring now to FIGS. 1 to 4, one preferred embodiment of the present invention will be described as follows.

At first, the constitution of the heat exchanger used in the gas liquefying method of the present invention will be described.

Figure 3:
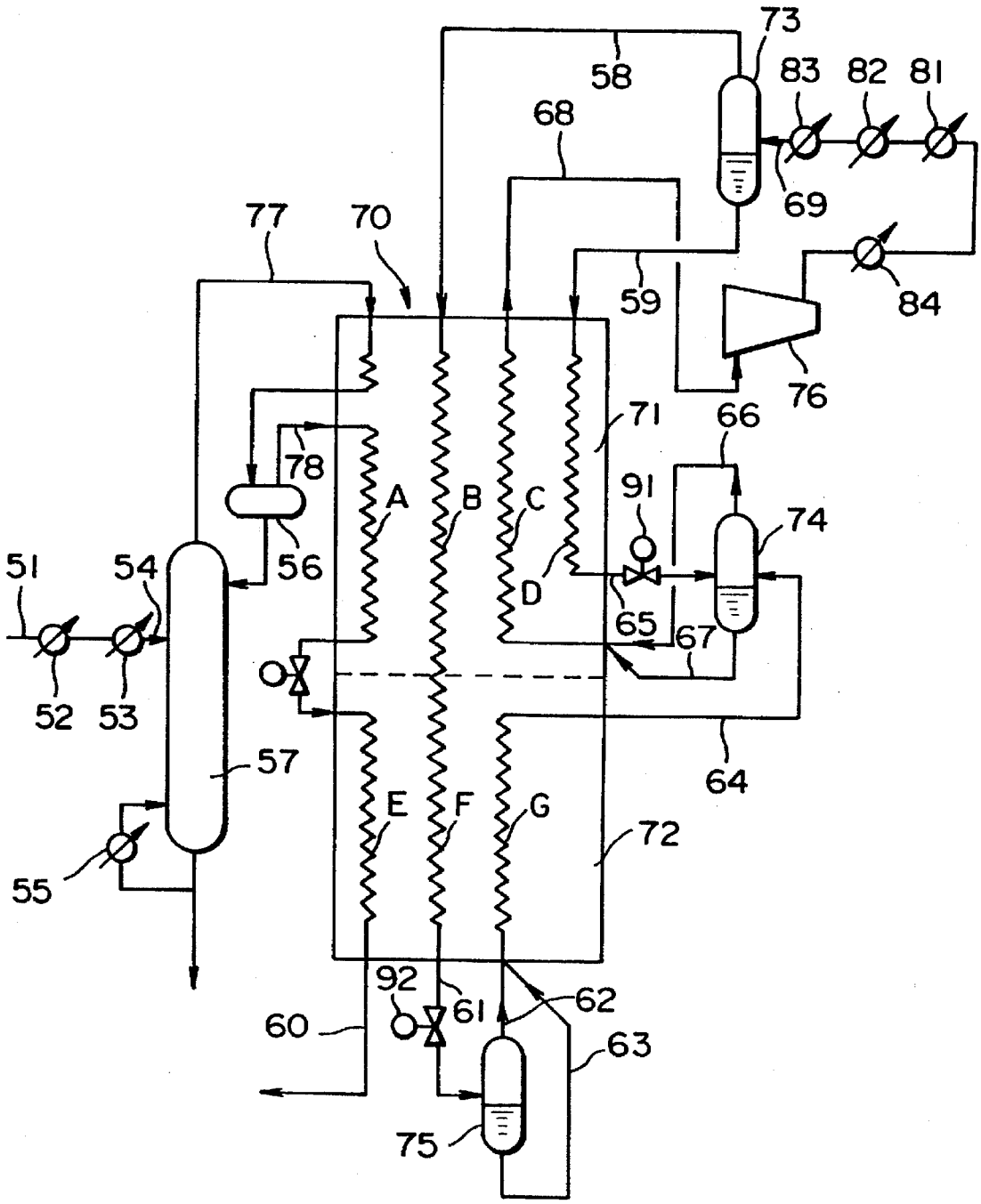
FIG. 3 is a view for illustrating a flow of fluid in one preferred embodiment of the heat exchanger of the present invention.

The heat exchanger of the present preferred embodiment is used at a liquefying section of a gas liquefying plant comprised of a pre-cooling section performed with the refrigerant in the single component system and a liquefying section with the refrigerant in the multi-component system. Then, the heat exchanging device is constructed such that as shown in FIG. 3, the gas flow such as natural gas or the like is cooled in three steps through the heat exchanging with the low pressure multi-component refrigerant flow, and the cooling stage in the high temperature region is arranged at a higher position than the cooling stage in the low temperature region in such a way that the condensed liquid flow present at the cooling stage in the low temperature region may not be flowed to the cooling stage in the high temperature region by its free fall when the operation is stopped.

Figure 4:
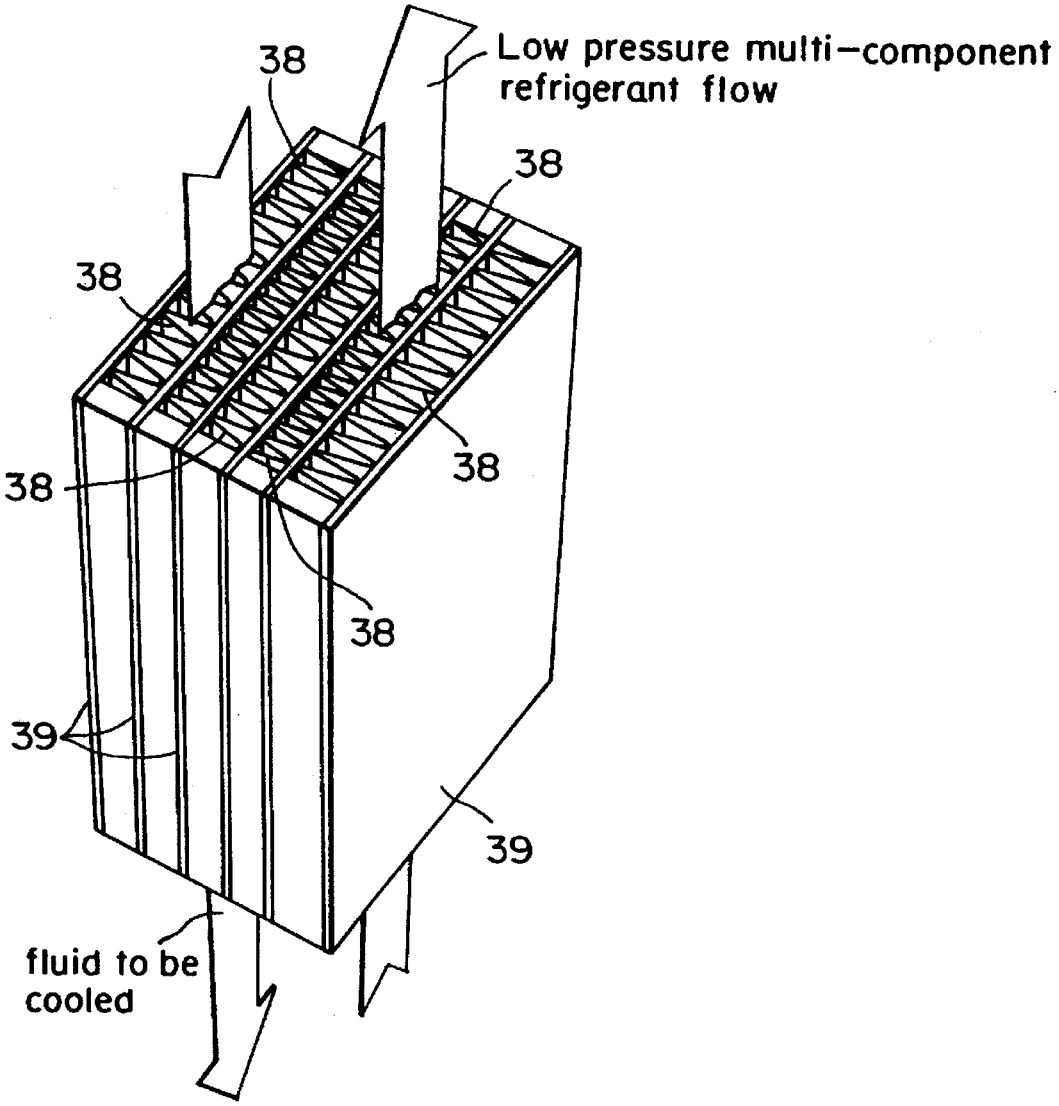
FIG. 4 is a perspective view for showing one preferred embodiment of the plate-fin type heat exchanger of the present invention.

The aforesaid cooling stage is formed by the plate-fin type heat exchanger having a high heat exchanging rate per unit volume, wherein the plate-fin type heat exchanger is constructed such that a plurality of corrugated fins 38 and a plurality of flat plates 39 are alternatively stacked as shown in FIG. 4, fluid to be cooled (natural gas, high pressure vapour flow of multi-component refrigerant or high pressure condensed liquid flow) passage and the low pressure multi-component refrigerant flow passage are alternatively arranged between the adjoining flat plates 39 and 39 in such a way that the fluid to be cooled and the low pressure multi-component refrigerant are contacted to each other through the flat plates 39.

Figure 1B:
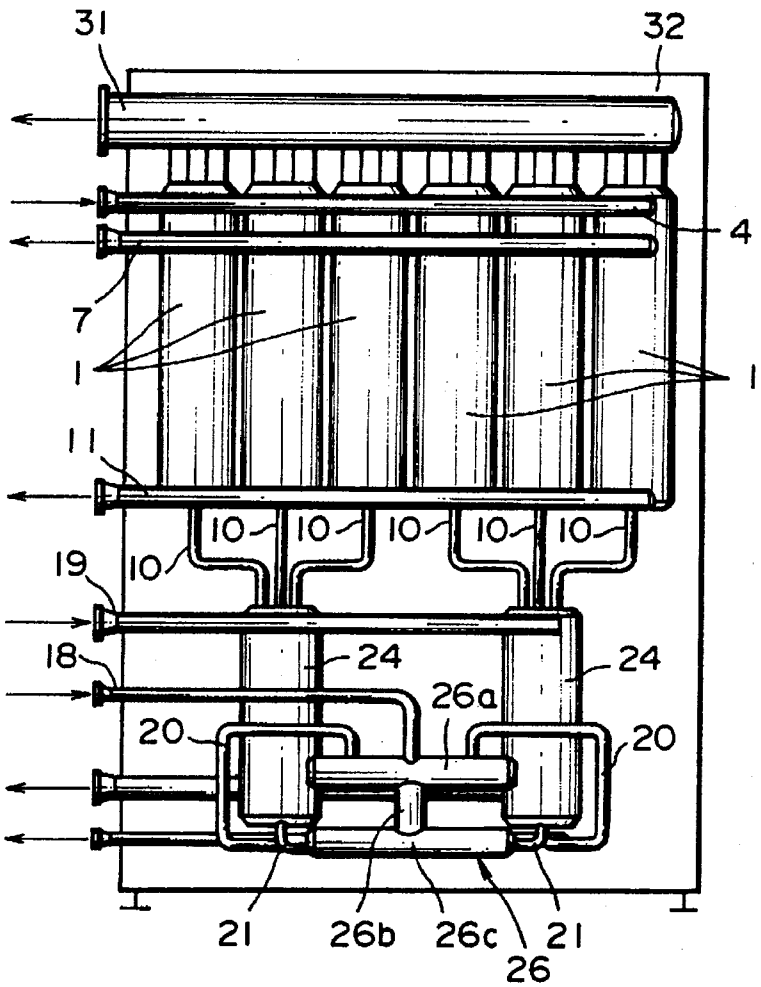
FIG. 1(*a*) is a side elevational view for showing one preferred embodiment of the heat exchanger of the present invention.
Figure 1A:
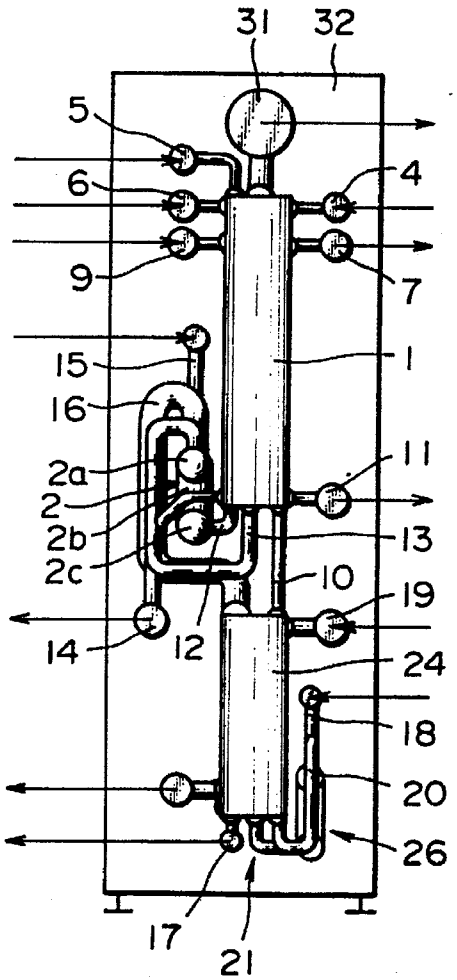

More practically, the heat exchanger is constructed such that, as shown in FIG. 1(*a*) and FIG. 1(*b*), a plurality of first plate-fin type heat exchangers 1 for setting the first cooling stage and the second cooling stage and a plurality of second plate-fin type heat exchangers 24, 24 for setting the third cooling stage are installed in parallel within the cooling container 32, respectively. With such an arrangement as above, since the heat exchanger is operated such that each of the heat exchangers 1 . . . 24, 24 performs a heat exchanging operation independently, so that an adjustment of the heat exchanging capability can be easily carried out by stopping specific number of heat exchanger 1 . . . 24, or by increasing the number of heat exchanger 1 . . . 24. In addition, the first plate-fin type heat exchangers 1 and the second plate-fin type heat exchangers 24, 24 are mounted vertically in such a way that the high temperature end parts may be located at higher positions than the cooling end parts, and the condensed liquid flow present at the cooling end parts is not flowed at the high temperature end part by its own free fall when stopped.

The aforesaid first plate-fin type heat exchangers 1 are constructed such that the passage of the fluid to be cooled is divided into at least three kinds of flow passages and the third passage for the fluid to be cooled is provided with a partition bar inside of it in such a way that the fluid passage may become a fluid passage which is independent in a vertical direction. The first cooling stage which becomes the highest temperature region is positioned above the aforesaid partition bar, and the second cooling stage which becomes the intermediate temperature region is positioned below the aforesaid partition bar.

A pipe 4 is connected to the upper end of the first passage of the fluid to be cooled and the high pressure condensed liquid flow of the multi-component refrigerant is supplied through the pipe 4. In turn, a pipe 5 is connected to the upper end of the second passage of the fluid to be cooled and the high pressure vapour flow of the multi-component refrigerant is supplied through the pipe 5. Then, these high pressure multi-component refrigerants advance downwardly in the first and second passages of the fluid to be cooled in the first plate-fin type heat exchangers 1 from the first cooling stage to the second cooling stage, respectively.

In addition, each of the pipes 6 and 7 is connected to the upper end and the lower end of the third passage of the fluid to be cooled in the first cooling stage, wherein the pipe 6 supplies the pre-cooled natural gas to the first cooling stage as the vapour flow. In addition, the pipe 7 is connected to the gas-liquid separator 56 (as shown in FIG. 3) so as to supply the natural gas passed through the first cooling stage to the gas-liquid separator 56.

The aforesaid gas-liquid separator 56 is connected to the upper end of the third passage of the fluid to be cooled in the second cooling stage through the pipe 9 so as to supply the vapour flow of the natural gas after gas-liquid separation is performed. In addition, a flash valve is connected to the lower end of the passage of the fluid to be cooled of the second cooling stage through the pipe 11, and the flash valve is connected to the plate-fin type heat exchangers 24, 24 through the pipe 19.

The aforesaid second plate-fin type heat exchangers 24, 24 are arranged below the first plate-fin type heat exchangers 1 in side-by-side relation so as to constitute the third cooling stage which becomes the lowest temperature region. Then, the passages of the fluid to be cooled in these second plate-fin type heat exchangers 24, 24 are divided into passages for the two kinds of fluids, wherein the aforesaid pipe 19 is connected to the upper end of the first passage of the fluid to be cooled so as to cause the natural gas to be supplied thereto. In turn, the lower end of the second passage of the fluid to be cooled of the first plate-fin type heat exchangers 1 is connected to the upper end of the second passage of the fluid to be cooled through pipe 10 so as to cause the high pressure vapour flow of multi-component refrigerant to be supplied from the first plate-fin type heat exchangers 1. Then, the lower end of the second passage of the fluid to be cooled is connected to the flash valve through the pipe 17, and the flash valve is connected to the gas-liquid separator 26 through the pipe 18.

As shown in FIG. 1(*b*), the aforesaid gas-liquid separator 26 is comprised of a tank which is formed into a lateral H-shape and further has an upper storing part 26*a*, an intermediate storing part 26*b* and a lower storing part 26*c*. The upper storing part 26*a* is constructed such that a hollow cylindrical member having both ends air-tightly sealed is installed laterally, through pipe 18, the flow obtained by expanding the high pressure vapour flow of multi-component refrigerant through the aforesaid flash valve (called as the second low pressure multi-component refrigerant flow) is discharged into the upper storing part 26*a*.

To the intermediate position of the aforesaid upper storing part 26*a* is connected the upper end of the intermediate storing part 26*b* having the hollow cylindrical member arranged in a vertical direction. To the lower end of the intermediate storing part 26*b* is connected the lower storing part 26*c* having the hollow cylindrical member air-tightly sealed at its both ends arranged laterally, wherein the lower storing part 26*c* and the upper storing part 26*a* are communicated to each other through the intermediate storing part 26*b*. Then, this gas-liquid separator 26 discharges the second low pressure multi-component refrigerant flow of gas-liquid mixture phase from the pipe 18, the liquid flow is stored in the lower storing part 26*c* and in turn the vapour flow is stored in the upper storing part 26*a*, thereby the gas and the liquid are separated from each other.

In addition, to the upper storing part 26*a* is connected a pipe 20 and further to the lower storing part 26*c* is connected a pipe 21. These pipes 20 and 21 are connected to the mixing device installed within the second plate-fin type heat exchangers 24 and 24, wherein the mixing device mixes the vapour flow of the second low pressure multi-component refrigerant flow separated at the gas-liquid separator 26 with the liquid flow of the second low pressure multi-component refrigerant flow.

Figure 2:
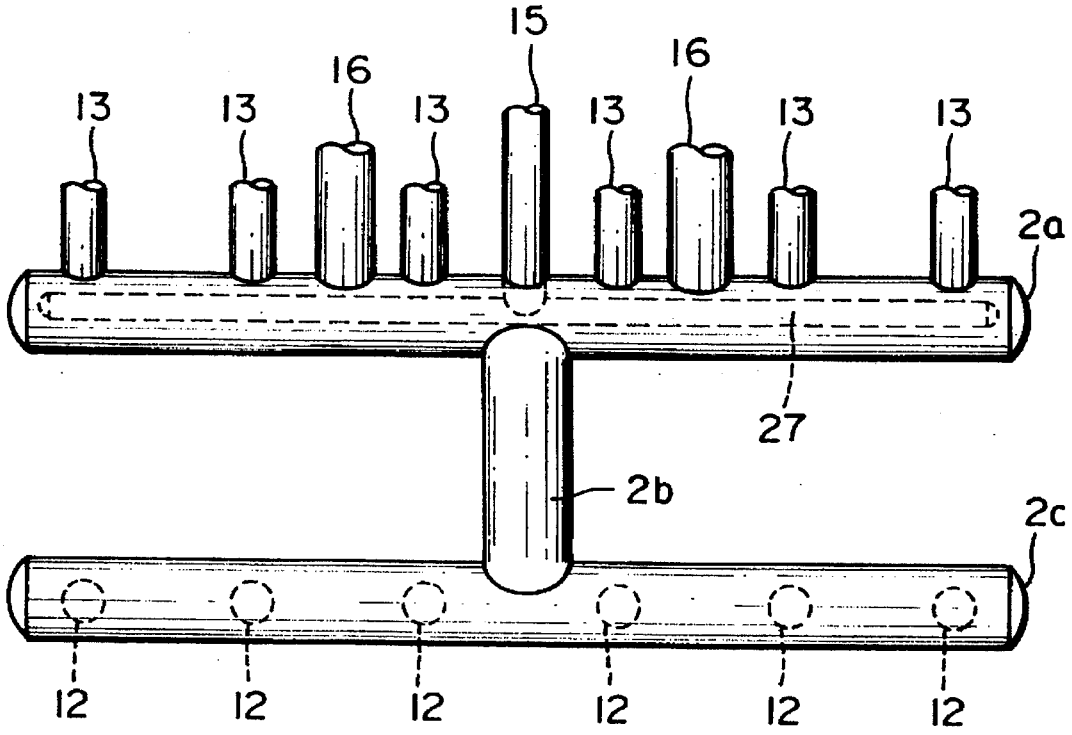
FIG. 2 is an expanded view for showing a substantial part of the gas-liquid separator shown in the side elevational view of FIG. 1(*a*).

The aforesaid mixing device is stored in the low pressure multi-component refrigerant flow passages of the second plate-fin type heat exchangers 24 and 24, and the upper end of the low pressure multi-component refrigerant flow passage is connected to the gas-liquid separator 2 through the pipe 16. The gas-liquid separator 2 has, as shown in FIG. 2, an upper storing part 2*a* having the injecting member 27 stored therein, an intermediate storing part 2*b* and a lower storing part 2*c* in the same manner as that of the aforesaid gas-liquid separator 26, wherein to the upper storing part 2*a* are connected a pipe 16, a pipe 15 and a pipe 13.

The aforesaid pipe 15 is connected to a flash valve and the flash valve is connected to the lower end of the first passage of the fluid to be cooled in the first plate-fin type heat exchangers 1 through the pipe 14. With such an arrangement as above, the flow obtained by expanding the high pressure condensed liquid flow of the multi-component refrigerant from the first plate-fin type heat exchangers 1 is supplied to the gas-liquid separator 2 through the pipe 15 and concurrently the second low pressure multi-component refrigerant flow obtained from the second plate-fin type heat exchangers 24 and 24 is supplied through the pipe 16. In this case, the aforesaid two kinds of fluid are uniformly mixed in their components within the gas-liquid separator 2, resulting in that the first low pressure multi-component refrigerant flow can be attained.

In addition, the upper storing part 2*a* of the gas-liquid separator 2 is connected to the mixing device stored at the lower ends of the first plate-fin type heat exchangers 1 through the pipe 13. Further, to the mixing device is connected the lower part storing part 2*c* of the gas-liquid separator 2 through the pipe 12. With such an arrangement as above, the first low pressure multi-component refrigerant flow of which gas and liquid are separated at the gas-liquid separator 2 is supplied to the mixing device through the pipe 13 and the pipe 12.

The aforesaid mixing device is connected to the lower end of the low pressure multi-component refrigerant flow passage of the first plate-fin type heat exchangers 1 so as to cause the first multi-component refrigerant flow generated by mixing to be ascended as cooling fluid. Then, to the upper end of the low pressure multi-component refrigerant flow passage is connected the pipe 31 so as to cause the first low pressure multi-component refrigerant flow passed through the low pressure multi-component refrigerant flow passage of the first plate-fin type heat exchangers 1 to be discharged through the pipe 31.

In addition, the heat exchanging device of the present preferred embodiment can be comprised of the first plate-fin type heat exchangers 1 and the second plate-fin type heat exchangers 24, 24 within a vertical refrigerating container 32 to which the fluid to be cooled and the refrigerant are supplied while a cooling temperature being divided in every predetermined range.

With such an arrangement as above, since the cooling temperature of the fluid to be cooled is classified for every predetermined range by the first plate-fin type heat exchangers 1 and the second plate-fin type heat exchangers 24 and 24, even if there is a certain limitation in shape or volume of the refrigerating container 32, it becomes possible to make an easy accommodation for it by changing arrangements or each number of the first plate-fin type heat exchangers 1 and the second plate-fin type heat exchangers 24 and 24 and thus a degree of freedom in design can be increased.

Then, the gas liquefying method of the present invention will be described in reference to FIG. 3.

As shown in FIG. 3, each of the high pressure condensed liquid flow of multi-component refrigerant flow having gas and liquid separated by a gas-liquid separator 73, a high pressure vapour flow of the multi-component refrigerant and natural gas pre-cooled at the pre-cooling section is supplied to each of the upper ends of the each passages of the fluid to be cooled in the plate-fin type heat exchangers 70, thereby each of these flows descends in each flow passage of the fluid to be cooled as the fluid to be cooled.

The multi-component refrigerant in the present invention is defined as a compound in which it contains several kinds of refrigerant components having low boiling points in sequence and at least one component has a lower boiling point than a cooling temperature of the fluid to be cooled, i.e. a liquefying temperature of gas. It is satisfactory that the multi-component refrigerant is properly selected in response to composition, temperature and pressure of raw material gas. For example, it is possible to apply mixtures of components selected from nitrogen, hydro-carbon with the number of carbons 1 to 5 and it is preferable to apply mixture composed of nitrogen, methane, ethane and propane. In addition, it is preferable to apply the compound having a range of 2 to 14 mol % of nitrogen, 30 to 45 mol % of methane, 32 to 45 mol % of ethane and 9 to 21 mol % of propane. In addition, ethylene can be used in place of ethane in mixture or propylene can be used in place of propane. In addition, as the single component refrigerant, it is possible to use hydro-carbon of low boiling point and it is preferable to apply propane. Although four kinds of flow passages in the high temperature region at the upper side of the plate-fin type heat exchanger 70 and three kinds of flow passages in the low temperature region at the lower side of the plate-fin type heat exchanger 70 are essential composing elements for performing the present invention, these elements may not prohibit an arrangement in which there are provided some flow passages at the high temperature region and/or the low temperature region in addition to these elements so as to be used for cooling other fluids (gas, liquid or gas-liquid mixture fluid).

As the raw material gas in the present invention, gas containing at least one kind of methane, ethane or the like having a low boiling point component can be applied. For example, natural gas can be used. The raw material gas flow 51 containing at least one low boiling point component, for example, natural gas having 49.9 barA (absolute pressure) and 21° C. is pre-cooled by groups of heat exchangers 52, 53 set under a condition in which it is gradually decreased to a low temperature with the single component refrigerant, propane, for example. Although the pre-cooling temperature is made different in reference to the kind of raw material gas, it is determined in consideration of energy consumption of an entire system. The pre-cooled gas flow 54 is processed such that a high boiling point component is separated by a high boiling point component separator 57 having a re-boiling device 55 as required, a purity degree of the low boiling point component is increased and the gas is fed from the upper part of the flow passage A of the high temperature region 71 of the plate-fin type heat exchanger 70. Gas flow 77 fed at the upper part of the high temperature region 71, for example, at 48.4 barA and −33° C. and cooled down to −45° C. is once extracted and fed into a returning flow drum 56, high boiling point condensate separated by a knock-out drum 56 is returned back to the upper part of the high boiling point component separator 57, and the gas flow 78 from which the condensate is removed by the knock-out drum 56 and having an increased high purity degree of the low boiling point component is fed into the flow passage A in the high temperature region 71. Gas flow fed into the flow passage A of the high temperature region 71 flows downwardly within the high temperature region 71. It is also possible to arrange a cooling device having the single component refrigerant in place of the high temperature region 71 of the plate-fin type heat exchanger 70 in order to cool the gas flow 77 extracted from the top part of the high boiling point component separator 57 and separate its condensate. In this case, it is possible for the gas flow having the condensate separated and removed therefrom to be fed into the upper part of the high temperature region 71 of the heat exchanger 70 and to pass within the high temperature region as it is without once being extracted during operation.

High pressure multi-component refrigerant comprised of nitrogen, methane, ethane and propane, for example, is heat exchanged in sequence by the heat exchangers 81, 82 and 83 set under a condition in which they show a low temperature in sequence with the same single component refrigerant as that used for pre-cooling the raw material gas, the refrigerant is ore-cooled until a part of it is condensed, the pre-cooled high pressure multi-component refrigerant is separated into a high pressure vapour flow 58 and a high pressure condensed liquid flow 59 by the gas-liquid separator 73, the high pressure vapour flow 58 is fed at the upper part of the flow passage B, and the high pressure condensed liquid flow 59 is fed at the upper part of the flow passage D, respectively. The first low pressure multi-component refrigerant flow (gas-liquid mixed phase flow) to be described later is fed at the lower part of the flow passage C in the high temperature region, set to be counter-flow against the gas flow in the passage A, the high pressure vapour flow in the passage B and the high pressure condensed liquid flow in the passage D so as to perform the heat exchanging operation with them. The first low pressure multi-component refrigerant flow (gas-liquid mixed phase) in the passage C is set to a low temperature, for example, 4.0 barA and −128° C. (at an inlet port of the high temperature region), so that the gas flow in the passage A, the high pressure vapour flow in the passage B and the high pressure condensed liquid flow in the passage D are heat exchanged with the refrigerant and cooled by them.

The gas flow 78 cooled in the passage A and the high pressure vapour flow 58 of the refrigerant cooled in the passage B at the high temperature region is fed from the upper part of each of the flow passages E and F respectively in the low temperature region 72, the second low pressure multi-component refrigerant flow (a gas-liquid mixed phase) to be described later is fed from the lower part of the passage G in the low temperature region, the refrigerant flow is oppositely flowed against the gas flow 78 in the passage E and the high pressure vapour flow 58 in the passage F so as to perform a heat exchanging operation with them. The second low pressure multi-component refrigerant flow (a gas-liquid mixed phase flow) in the passage G is set to be a further lower temperature, 4.1 barA and −168° C. (at an inlet port of the low temperature region), for example, so that the gas flow 78 in the passage E and the high pressure vapour flow 58 in the passage F are further cooled. When the gas flow 78 passed through the passage A in the high temperature region 71 is fed into the flow passage E in the low temperature region 71, the liquefied gas flow 60 is expanded as shown in FIG. 3 and extracted from the lower part of the low temperature region, further expanded (not shown), set to be a low pressure and recovered as a product having about 1 atm and −162° C.

Vapour part and condensed part got by expanding liquefied high pressure vapour flow 61 of multi-component refrigerant extracted from the lower part of the low temperature region, having 47.0 bar and −162° C., for example, with the expansion valve 92 are separated into gas and liquid by the gas-liquid separator 75, the separated vapour part 62 and the condensed part 63 are mixed to each other, fed into the passage G from the lower part of the low temperature region as the second low pressure multi-component refrigerant flow of about 4.1 barA and −168° C., oppositely flowed against the gas flow in the passage E and the high pressure vapour flow of the multi-component refrigerant in the passage F passed from the upper part to the lower part within the low temperature region and heat exchanged with them, thereafter the refrigerant is extracted from the upper part of the low temperature region.

The second low pressure multi-component refrigerant flow 64 passed through the flow passage G and extracted from the upper part of the low temperature region and the flow of 4.9 barA and −128° C. got through the expansion, at the expansion valve 91, of the high pressure condensed liquid flow 65 of 47 barA and −124°, for example, after passing through the passage G of the high temperature region are mixed and then gas and liquid are separated by the gas-liquid separator 74. The separated vapour part 66 and the liquid part 67 are mixed to each other to feed the mixture as the first low pressure multi-component refrigerant flow from the lower part of the flow passage C in the high temperature region, oppositely flowed against the gas flow in the flow passage A passing within the high temperature region, the high pressure vapour flow of the multi-component refrigerant in the flow passage B and the high pressure condensed liquid flow of the multi-component refrigerant in the flow passage D so as to be heat exchanged, thereafter it is extracted from the upper part of the high temperature region as vapour of about 3.6 barA and −36° C. It is preferable that a pressure loss in the flow passage of the low pressure multi-component refrigerant flow (the flow passage G+the flow passage C) is set to be 0.5 bar or less.

The first low pressure multi-component refrigerant flow 68 extracted from the upper part of the flow passage C in the high temperature region is compressed by the compressor 76, heat exchanged with non-hydro carbon refrigerant, for example, air or water at the multi-component refrigerant cooling device 84 and cooled there, then the high pressure multi-component refrigerant 69 of mixed phase of about 48.0 barA and −33° C. partially condensed through heat exchanging operation with the single component refrigerant at the groups of heat exchangers 81, 82 and 83 applied again for a liquefication of gas. The same single component refrigerant is used for the pre-cooling of the raw material gas and the pre-cooling of the high pressure multi-component refrigerant. As the cooling system of the single component refrigerant, it is employed to provide a method in which the refrigerant is normally circulated in a cycle comprising the steps of compressing the single component refrigerant, cooling it and making its complete condensation, thereafter heat exchanging it in sequence with the fluid to be cooled at a low pressure and a low temperature and compressing the vapour of the single component refrigerant gasified by the heat exchanging operation. In addition, it is also possible that the pre-cooling of the aforesaid raw material gas and the pre-cooling of the high pressure multi-component refrigerant are constituted within the closed cycle of one single component refrigerant. For example, in FIG. 3, the single component middle pressure refrigerant (liquid) obtained by compressing and cooling the single component refrigerant is fed into a pre-cooling device 52 so as to cool the raw material gas flow, the single component low pressure refrigerant (a gas and liquid mixed phase) obtained by expanding the single component middle pressure refrigerant (liquid) extracted from the pre-cooling device 52 is fed into the pre-cooling device 53, and the raw material gas after being cooled by the pre-cooling device 52 is further cooled at a low pressure and a low temperature. Vapour of the single component refrigerant gasified through a heat exchanging operation with the raw material gas is fed from each of the pre-cooling devices to a compressor, its pressure is increased, then it is condensed with air or water and the refrigerant is also used again for cooling the raw material gas flow. Also in the case that the high pressure multi-component refrigerant is cooled with the single component refrigerant until it is partially condensed, it is also possible that this operation can be performed in the same manner as that of the aforesaid processing by performing a heat exchanging operation in sequence at a low pressure and a low temperature. For example, the single component high pressure refrigerant (liquid) is fed into the multi-component refrigerant pre-cooling device 81 so as to cool the high pressure multi-component refrigerant, the single component middle pressure refrigerant (a gas-liquid mixed phase) obtained by expanding the single component high pressure refrigerant (liquid) extracted from the multi-component refrigerant pre-cooling device 81 is fed into the multi-component refrigerant pre-cooling device 82, the high pressure multi-component refrigerant after being cooled by the pre-cooling device 81 is cooled at a low pressure and a low temperature, the single component low pressure refrigerant (a gas-liquid mixed phase) obtained by expanding the single component middle pressure refrigerant (liquid) extracted from the multi-component refrigerant pre-cooling device 82 is fed into the multi-component refrigerant pre-cooling device 83, and the high pressure multi-component refrigerant after being cooled with the pre-cooling device 82 is further cooled at a lower pressure and a lower temperature so as to condense a part of the high pressure multi-component refrigerant. Vapour of the single component refrigerant gasified through the heat exchanging with the multi-component refrigerant is fed from each of the pre-cooling devices to the compressor so as to increase its pressure, then it is condensed with air or water, and the refrigerant can be used again as the single component high pressure refrigerant (liquid) for cooling the multi-component refrigerant. The cooling cycle of the single component refrigerant for use in pre-cooling operation for the aforesaid raw material gas and the cooling cycle for the single component refrigerant for use in pre-cooling the multi-component refrigerant constitute one closed cycle while sharing the compressor for the single component refrigerant to each other.

In the present invention, the pre-cooled gas flow 78 of the fluid to be cooled, the high pressure vapour flow 58 of the multi-component refrigerant and the high pressure condensed liquid flow 59 of the refrigerant are fed to flow from the upper part to the lower part of the heat exchanger. In turn, each of the first low pressure multi-component refrigerant flows (66+67) acting as the cooling fluid and the second low pressure multi-component refrigerant flows (62+63) are fed in the region in the heat exchanger having each of the fluids passed therethrough so as to flow from the lower part toward the upper part. With such an arrangement as above, since the fluid to be cooled fed into the upper part of the heat exchanger is condensed while reaching the lower part in the region where the fluid passes while being cooled, a high static pressure of liquid is applied in the flow passage and its pressure loss is eliminated. Due to this fact, an actual pressure loss is remarkably reduced to cause a temperature difference between the condensing curve for the fluid to be cooled and the evaporating curve for the cooling fluid to be increased to open wide, so that a heat transfer area of the heat exchanger can be reduced and this becomes effective in designing of a heat exchanger. Alternatively, if the temperature difference between the condensing curve for the fluid to be cooled and the evaporating curve for the cooling fluid is kept at the same degree of the previous one, a load of the compressor can be reduced by reducing a flow rate of the multi-component refrigerant or adjusting a composition of the refrigerant.

In addition, in the case that a flow of fluid within the heat exchanger is stopped and that a low temperature end of low temperature fluid is located at the top end of the heat exchanger as found in the heat exchanger described in the aforesaid gazette of Japanese Patent Publication No. Sho 47-29712, the refrigerant liquid at the low temperature end flows downward to the bottom part of the high temperature end by its own gravity while the refrigerant liquid at the low temperature end is not heat exchanged, resulting in that a heat exchanging is produced between the former and the refrigerant vapour of high temperature accumulated at the bottom part of the heat exchanger, a rapid boiling of the low temperature liquid is generated and a pressure within the heat exchanger is increased. In addition, there is a possibility that there occurs a temperature difference more than its design value at an aluminum tube to cause a thermal stress fatigue to occur at aluminum material, although in the present invention, even if the flow of fluid within the heat exchanger is stopped, an inverse flow of the low temperature liquid caused by its own gravity does not occur, so that its safety characteristic can be maintained.

In order to make a sufficient realization of a performance of the heat exchanger, each of the fluids must be uniformly distributed in each of the flow passages. Due to this fact, in the present invention, fluid of gas-liquid mixed phase obtained after expansion as described above is separated into vapour part and liquid part after mounting the separator, thereafter the separated vapour part and the liquid part are fed into the inlet port of the heat exchanger while they are well being mixed to each other. That is, as to the vapour flow 61 of the liquefied multi-component refrigerant, the vapour part obtained after expansion and condensed part are separated by the gas-liquid separator 75, thereafter the separated vapour part 62 and the liquid part 63 are fed into the flow passage G from the lower part of the low temperature region as the second low pressure multi-component refrigerant flow while they are sufficiently mixed to each other, the gas flow in the flow passage E passing within the low temperature region is heat exchanged with the high pressure vapour flow of the multi-component refrigerant. It is preferable that a mixing of the separated vapour part 62 and the liquid part 63 is carried out just before they are fed into the low temperature region. As the mixing method, the vapour part and the condensed part are supplied up to the inlet part of the heat exchanger independently in a single phase, they are changed into a mixed phase flow once. For example, there may be employed to provide a gas-liquid dispersion device in which a dispersion core (a multi-layer fluid passage collecting device) for use in supplying each of the vapour part (gas) and the liquid part (liquid) in a single phase is fixed to a fluid taking port of the heat exchanger, gas dispersion fins (a laminated fluid passage) and liquid dispersion fins are arranged within the dispersion core while being adjacent to each other, gas and liquid flowing in each of the adjoining dispersion fins are flowed into the two-phase (mixed phase) flow distribution fins and merged so as to make a gas-liquid mixed phase flow (a gazette of Japanese Patent Publication No. Sho 63-52313); a gas-liquid dispersion device in which a gas-liquid dispersion core composed of a gas-liquid merging layer and a flowing passage layer is arranged within the heat exchanger header, the gas and liquid are separately flowed into the device and merged at the merging layer (a gazette of Japanese Patent Publication No. Sho 63-52312); and a gas-liquid dispersion device in which the gas and liquid are separately supplied up to a center bar (a central distributing pipe having a through-pass groove at a side surface) arranged at either an inlet or an intermediate part of the effective fins of the heat exchanger and merged at the center bar or the like. In addition, although it is possible to use a system of heat exchanger in which the plate partitioning the adjoining fluid passages from each other is provided with holes and gas and liquid are mixed to each other within the core (the specification of U.S. Pat. No. 3,559,722), the aforesaid gas-liquid dispersion device is more preferable.

The second low pressure multi-component refrigerant 64 passed through the flow passage G in the low temperature region 72 and extracted from the upper part is mixed with the flow got by expanding the high pressure condensed liquid flow 65 of the multi-component refrigerant after passing through the flow passage D in the high temperature region so as to separate gas and liquid. The flow obtained by expanding the high pressure condensed liquid flow 65 of the multi-component refrigerant and the second low pressure multi-component refrigerant flow 64 passed through the low temperature region and extracted have different temperature, different composition and different gas-liquid ratio from each other, their mixing may sometimes cause their temperatures to be increased. It is desirable to adjust most suitably an outlet temperature of the high pressure condensed liquid flow of the multi-component refrigerant at the high temperature region of and an outlet temperature of the second multi-component refrigerant flow at the low temperature region so as to restrict the increasing in temperature caused by mixing to its minimum value. In order to attain this effect, it is preferable that the temperature of the high pressure condensed liquid flow of the multi-component refrigerant is from −110° to −130° C. at the outlet of the high temperature region. In addition, it is preferable that the temperature of the second low pressure multi-component refrigerant flow at the outlet in the low temperature region is lower by 5° to 10° C. than that of the high pressure condensed liquid flow of the multi-component refrigerant at the outlet of the high temperature region. A method for mixing the flow obtained by expanding the high pressure condensed liquid flow 65 of the multi-component refrigerant with the second low pressure multi-component refrigerant flow 64 passed through and extracted from the low temperature region may be carried out such that the mixing and gas-liquid separation are concurrently carried out by feeding both flows into the gas-liquid separator 74 as shown in FIG. 3 and both of them may be mixed to each other before they are fed into the gas-liquid separator, thereafter they may be fed into the gas-liquid separator 74. In order to make a uniform mixing ratio of gas and liquid within the flow passage, the separated vapour part 66 and the liquid part 67 are fed into the flow passage C from the lower part of the high temperature region as the first low pressure multi-component refrigerant flow under a state in which the vapor part and the liquid part are being sufficiently mixed from each other, and they are heat exchanged with the gas flow passing in the flow passage A in the high temperature region, the high pressure vapor flow of the multi-component refrigerant passing in the flow passage B and the high pressure condensed liquid flow of the multi-component refrigerant passing in the flow passage D. It is preferable that mixing of the separated vapour part 66 and the liquid part 67 is carried out just before they are fed into the high temperature region. As this mixing method, it can be carried out in the same manner as that of mixing of the vapour part 62 and the liquid part 63 to be fed into the low temperature region. More practically, it is also possible to apply the methods described in the aforesaid gazettes of Japanese Patent Publication No. Sho. 63-52313, 63-52312 and 58-86396, respectively.

As described above, also in the case that the low pressure multi-component refrigerant is to be fed into any of the high temperature region or the low temperature region, the refrigerant is fed as the mixed phase fluid completely mixed at the inlet port of each of the regions of the heat exchanger, after the low pressure multi-component refrigerant of gas-liquid phase is gas-liquid separated, thereby a logarithm average temperature difference with the fluid to be cooled can be set large and the heat transfer area of the heat exchanger can be reduced due to a presence of the low evaporating temperature over the long temperature region in the evaporating curve of the heat exchanger for the low pressure multi-component refrigerant as compared with the method in which the gaseous phase and the liquid phase are separately fed after gas-liquid separation into either the high temperature region or the low temperature region of the heat exchanger. For example, (1) as compared with a method (FIG. 7) in which the low pressure multi-component refrigerant is fed as the mixed phase fluid in the low temperature region and the gaseous phase and the liquid phase are separately fed in the high temperature region, the present invention for feeding the fluid as the mixed phase fluid to both low temperature region and high temperature region has a lower evaporating temperature by about 7° C. over the long temperature region in the evaporating curve (FIG. 9) for the low pressure multi-component refrigerant in the high temperature region; (2) as compared with a method (FIG. 8) in which the gaseous phase and liquid phase of low pressure multi-component refrigerant in the low temperature region are separately fed and they are fed as the mixed phase fluid in the high temperature region, the present invention for feeding them as the mixed phase fluid to both low temperature region and high temperature region has a lower evaporating temperature by about 2° C. over the long temperature region in the evaporating curve (FIG. 10) for the low pressure multi-component refrigerant in the low temperature region. In view of the above (1) and (2), the present invention for feeding the low pressure multi-component refrigerant as the mixed phase fluid to both low temperature region and high temperature region has the low evaporating temperature over the long temperature region in the evaporating curve for the low pressure multi-component refrigerant in the low temperature region and the high temperature region as compared with the case (FIG. 6) in which the gaseous phase and the liquid phase of the low pressure multi-component refrigerant are separately fed in any of the regions, so that the present invention is effective in view of design of the heat exchanger.

Figure 6:
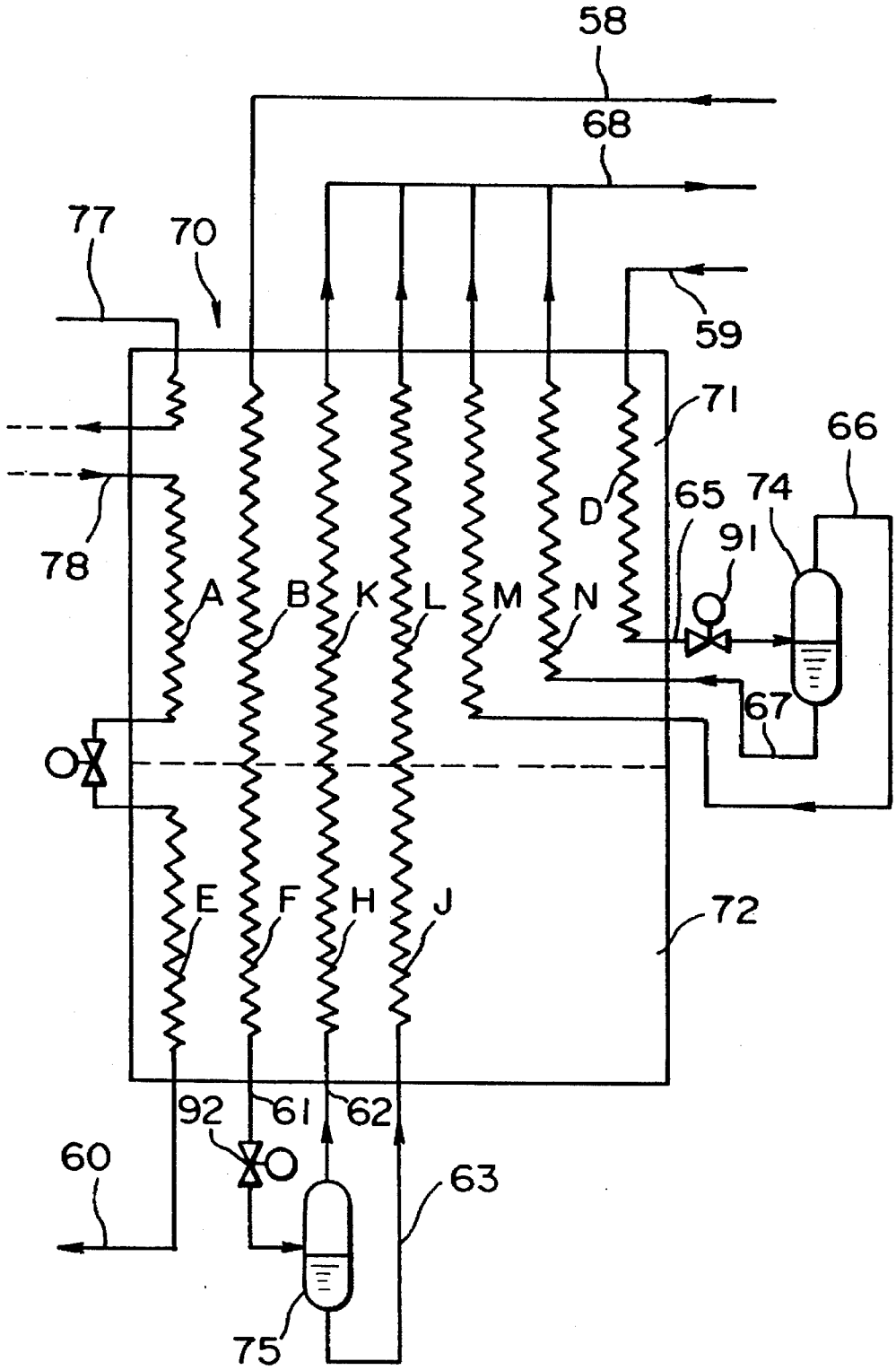
FIG. 6 is an illustrative view for showing a method for feeding each of the vapour flow and the condensed liquid flow after expansion of the multi-component refrigerant in both the high temperature region and the low temperature region separately into the heat exchanger (comparison example 1).

In the case of the method (a comparison example 1) shown in FIG. 6, it is similar to the case of the present invention shown in FIG. 3 that the pre-cooled raw material gas flow 78 obtained from the upper part of the flow passage A, the high pressure vapour flow 58 of the multi-component refrigerant obtained from the upper part of the flow passage B and the high pressure condensed liquid flow 59 of the multi-component refrigerant obtained from the upper part of the flow passage D of the flow passages in the high temperature region 71 of the plate-fin type heat exchanger 70 having a high temperature region 71 mounted with its plate surface being mounted upright and composed of seven kinds of flow passages A, B, D, K, L, M and N at the upper part and a low temperature region 72 composed of four flow passages E, F, H and J at the lower part. It is different from the present invention that a flow obtained by expanding the high pressure condensed liquid flow 65 of the multi-component refrigerant with the expansion valve 91 after passing through the flow passage D in the high temperature region is gas-liquid separated by the gas-liquid separator 74, the separated vapour part 66 is fed from the lower part of the flow passage M and the separated liquid 67 is fed from the lower part of the flow passage N, oppositely flowed against the gas flow in the flow passage A passed in the high temperature region, the high pressure vapour flow of the multi-component refrigerant in the flow passage B and the high pressure condensed liquid flow of the multi-component refrigerant in the flow passage D and heat exchanged with them, thereafter they are extracted from the upper part of the high temperature region as the vapour 68, that is, the vapour part 66 and the liquid part 67 are fed into each of the different flow passages in the plate-fin type heat exchanger separately without being mixed from each other. In addition, although it is similar to the present invention shown in FIG. 3 that the raw material gas flow 78 flowed in the flow passage A in the high temperature region and cooled there is fed into the flow passage E of the low temperature region 72, and the high pressure vapour flow 58 of the multi-component flowed in the flow passage B in the high temperature region and cooled there is fed into the flow passage F, it is different from the present invention that the flow obtained by expanding with the expansion valve 92 the high pressure vapour flow 61 of the multi-component refrigerant after being passed through the flow passage F in the low temperature region is separated into gas and liquid by the gas-liquid separator 75, the separated vapour part 62 is fed from the lower part of the flow passage H, subsequently the flow is fed into the lower part of the flow passage K in the high temperature region, the liquid part 63 is fed into from the lower part of the flow passage J, subsequently fed into the lower part of the flow passage L in the high temperature region, respectively, and oppositely flowed against the fluid to be cooled and heat exchanged with it, thereafter the condensed part is extracted from the upper part of the high temperature region as vapour 68, that is, the vapor part 62 and the liquid part 63 are fed into each of different flow passages of the plate-fin type heat exchanger separately without being mixed to each other, and the flow obtained by expanding with the expansion valve 91 the high pressure condensed liquid flow 65 of the multi-component refrigerant is passed through the flow passage in the low temperature region without having any relation with the vapour part 66 and the liquid part 67 separated into gas and liquid.

Figure 7:
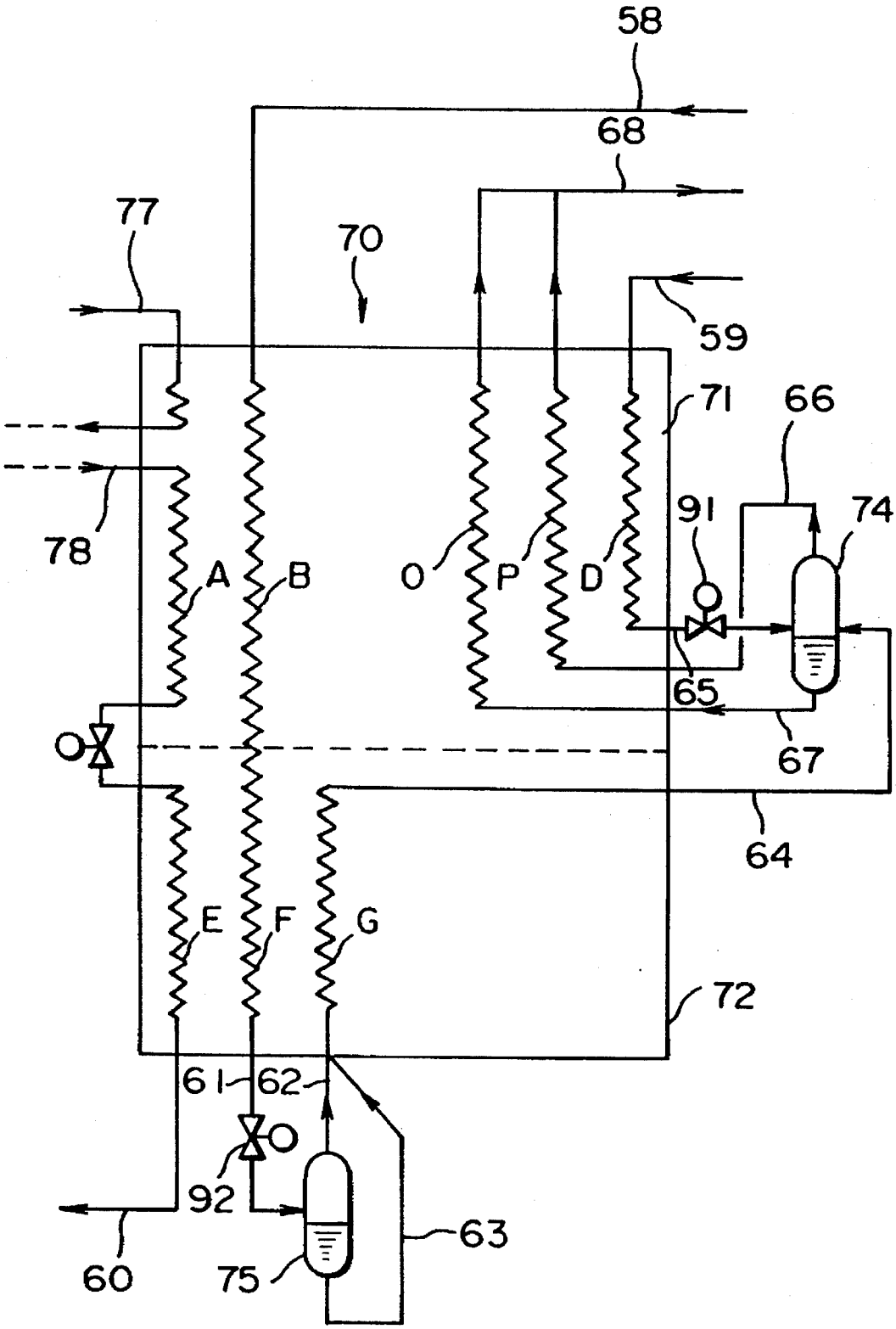
FIG. 7 is an illustrative view for showing a method for feeding each of the vapour flow and the condensed liquid flow into the heat exchanger after expansion of the multi-component refrigerant at the high temperature region (comparison example 2).

In the case of the method shown in FIG. 7 (a comparison example 2), it is similar to the case of the present invention shown in FIG. 3 that the pre-cooled raw material gas flow 78 is fed from the upper part of the flow passage A in the flow passages in the high temperature region 71, the high pressure vapour flow 58 of the multi-component refrigerant is fed from the upper part of the flow passage B and the high pressure condensed liquid flow 59 of the multi-component refrigerant is fed from the upper part of the flow passage D of the flow passages in the high temperature region 71 of the plate-fin type heat exchanger 70 having a high temperature region 71 set with its plate surface being mounted upright and composed of five kinds of flow passages A, B, D, O and P at the upper part and a low temperature region 72 composed of three flow passages E, F and G at the lower part, a flow obtained by expanding the high pressure condensed liquid flow 58 of the multi-component refrigerant with the expansion valve 92 after passing through the flow passage B in the high temperature region and through the flow passage F in the low temperature region is gas-liquid separated by the gas-liquid separator 75, the separated vapour part 62 and the condensed part 63 are mixed to each other to have mixed phase and fed from the lower part of the low temperature region into the flow passage G, oppositely flowed against the gas flow in the flow passage E passed in the low temperature region, and the high pressure vapour flow of the multi-component refrigerant in the flow passage F and heat exchanged with them, thereafter they are extracted from the upper part of the low temperature region as the second low pressure multi-component refrigerant 64, and mixed with a flow obtained by expanding the high pressure condensed liquid flow 65 of the multi-component refrigerant with the expansion valve 91 after passing through the flow passage D in the high temperature region. However, it is different from the present invention in view of the facts that a flow obtained by expanding with the expansion valve 91 the high pressure condensate liquid flow 59 of the multi-component refrigerant after passing through the flow passage D in the high temperature region is mixed with the second low pressure multi-component refrigerant 64, separated into gas and liquid by the gas-liquid separator 74, the separated vapor part 66 is fed into the lower part of the flow passage P and the liquid part 67 is fed into the lower part of the flow passage O and passed in the high temperature region, i.e. the separated vapor part 66 and the liquid part 67 are mixed from each other and are not passed in the flow passage in the high temperature region as the gas-liquid mixed phase.

Figure 9:
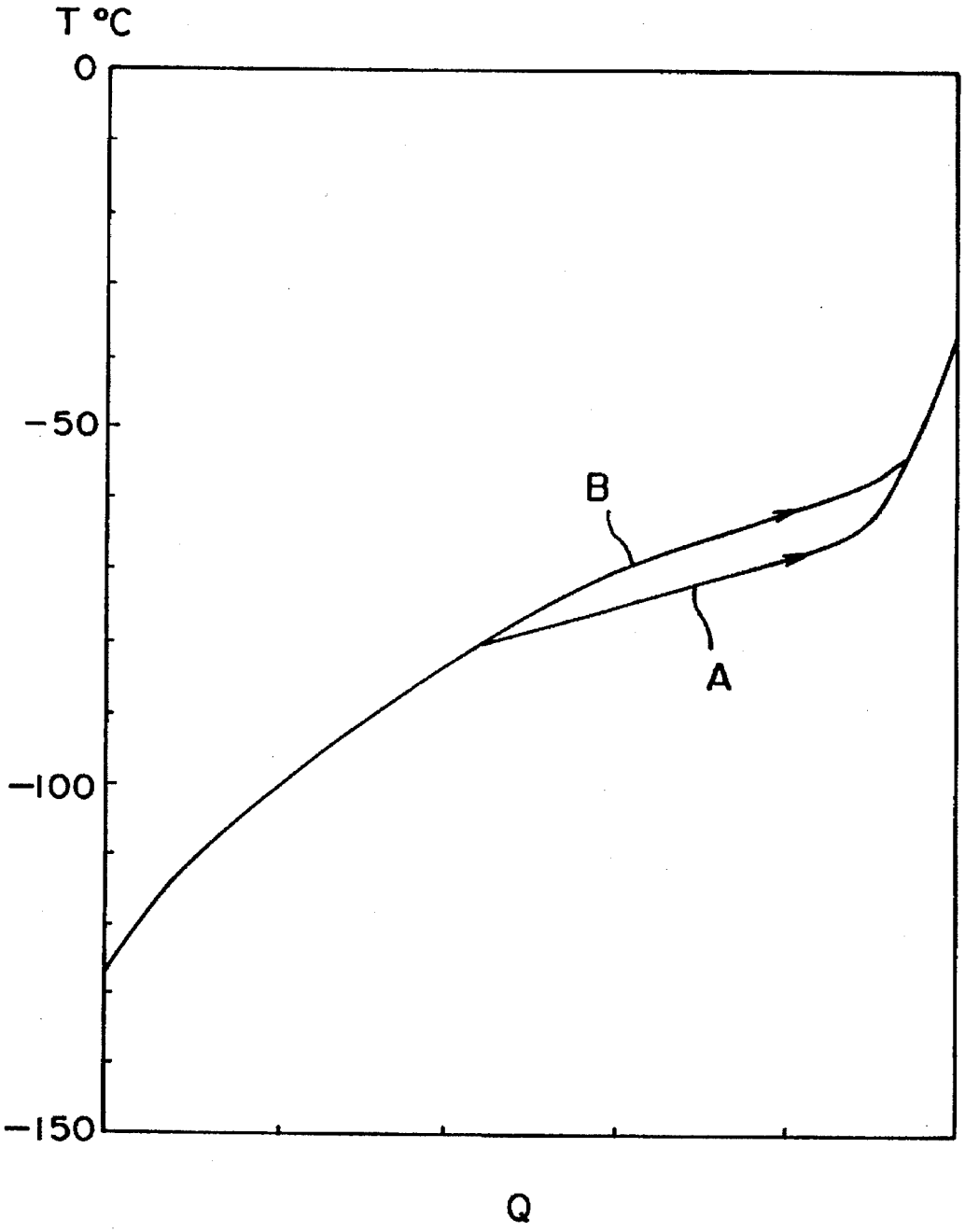
FIG. 9 is a view for showing a relation between a heat exchanging amount Q and a temperature T at the high temperature region of the method of the present invention in FIG. 3 and the method shown in FIG. 7.

FIG. 9 is a view for illustrating a difference between the method of the present invention and the method shown in FIG. 7 in reference to the characteristic of the evaporating curve for the cooling fluid in the high temperature region. In FIG. 9, the abscissa denotes a heat exchanging amount Q and the ordinate denotes a temperature T(° C.), wherein the line A denotes an evaporating curve for the first low pressure multi-component refrigerant in the present invention having the configuration shown in FIG. 3, the line B denotes a combined evaporating curve for the low pressure multi-component refrigerant in the high temperature region in the comparison example 2 of the configuration shown in FIG. 7 (an evaporating curve in the flow passage O+an evaporating curve in the flow passage P). Since the line A indicates the lower evaporating temperature by about 7° C. as compared with the line B over the long temperature region, resulting in that a logarithm average temperature difference with the fluid to be cooled can be set large and a heat transfer area of the heat exchanger can be reduced.

Figure 8:
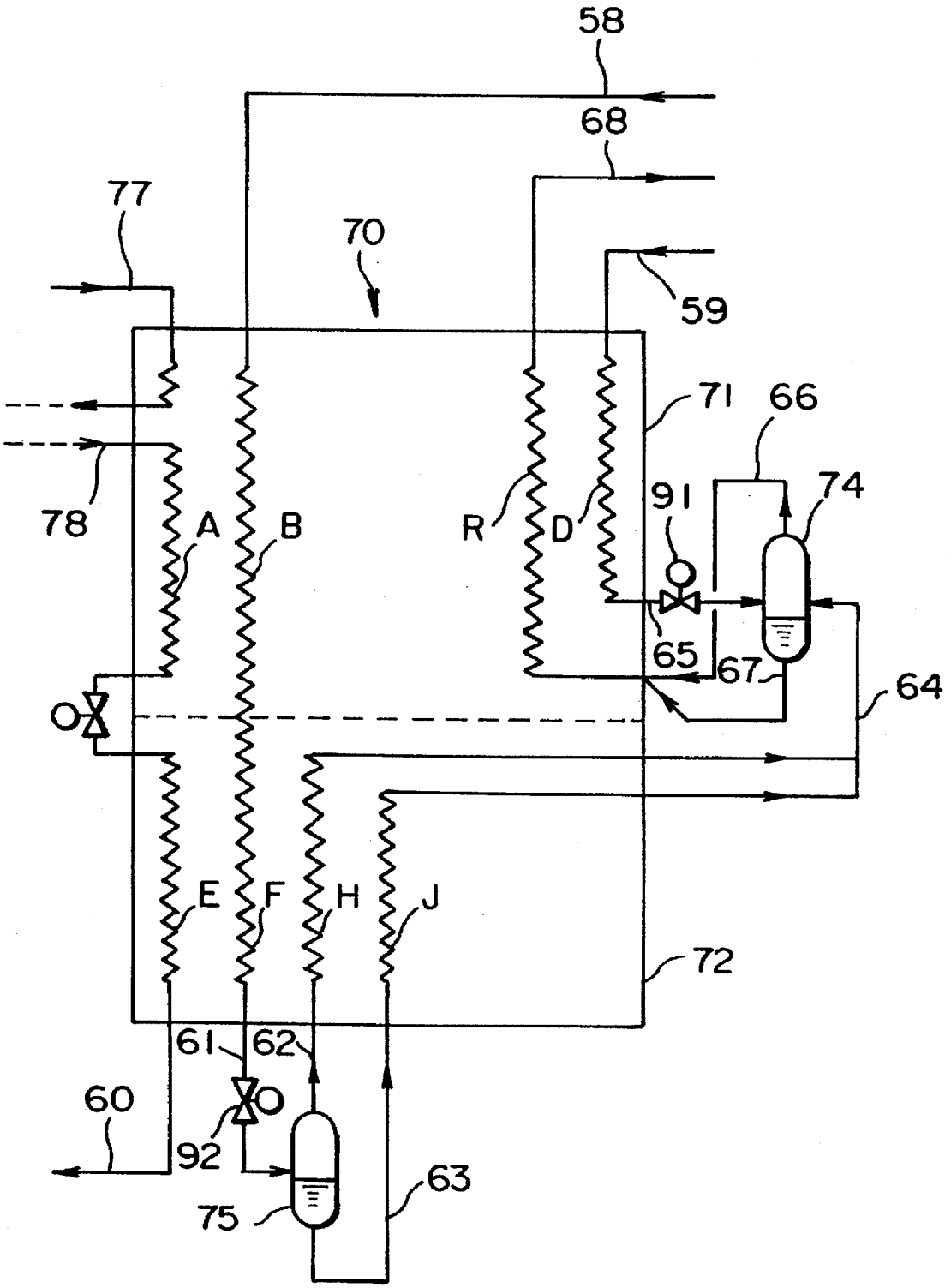
FIG. 8 is an illustrative view for showing a method for feeding each of the vapour flow and the condensed liquid flow separately after expansion of the multi-component in the low temperature region (comparison example 3).

In the case of a method (a comparison example 3) shown in FIG. 8, it is similar to the case of the present invention shown in FIG. 3 that the pre-cooled raw material gas flow 78 is fed from the upper part of the flow passage A in the flow passages in the high temperature region 71, the high pressure vapour flow 58 of the multi-component refrigerant is fed from the upper part of the flow passage B and the high pressure condensed liquid flow 59 of the multi-component refrigerant is fed from the upper part of the flow passage D of the plate-fin type heat exchanger 70 having a high temperature region 71 set with its plate surface being mounted upright and composed of four kinds of flow passages A, B, D and R at the upper part and a low temperature region 72 composed of four flow passages E, F, H and J at the lower part, a flow obtained by expanding the high pressure condensed liquid flow 61 of the multi-component refrigerant with the expansion valve 92 after passing through the flow passage B in the high temperature region and through the flow passage F in the low temperature region is gas-liquid separated by the gas-liquid separator 75. However, it is different from the present invention that the vapour part 62 and the condensed part 63 which are gas-liquid separated by the gas-liquid separator 75 are not mixed from each other, but separately fed into each of the flow passage H and the flow passage J from the lower part of the low temperature region, oppositely flowed against the gas flow in the flow passage E passing in the low temperature region and the high pressure vapour flow in the flow passage F and then heat exchanged with them. The low pressure multi-component refrigerant flow 64 passed through the flow passages H and J and extracted from the upper part in the low temperature region is mixed with a flow obtained by expanding with the expansion valve 91 the high pressure condensed liquid flow 65 after passing through the flow passage D in the high temperature region, separated into gas and liquid by the gas-liquid separator 74, the separated vapour part 66 and the condensed part 67 are mixed, fed from the lower part of the flow passage R in the high temperature region as the first low pressure multi-component refrigerant flow, oppositely flowed against the gas flow in the flow passage A passing in the high temperature region, the high pressure vapour flow of the multi-component refrigerant in the flow passage B and the high pressure condensed liquid flow of the multi-component refrigerant in the flow passage D so as to be heat exchanged with them.

Figure 10:
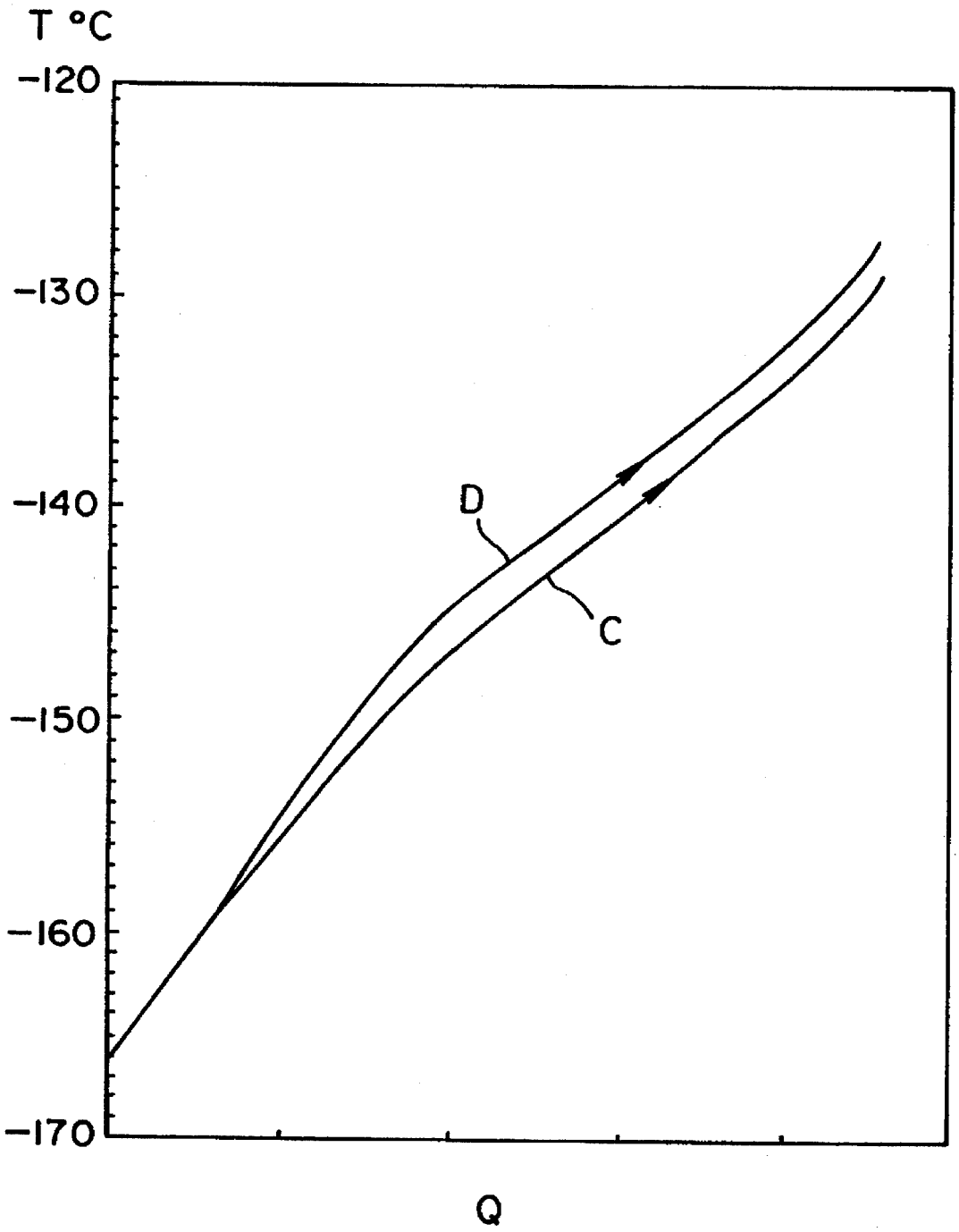
FIG. 10 is a view for showing a relation between the heat exchanging amount Q and the temperature T at the low temperature region in the method of the present invention shown in FIG. 3 and the method shown in FIG. 8.

FIG. 10 is a view for illustrating a difference between the method of the present invention shown in FIG. 3 and the method shown in FIG. 8 in reference to the characteristic of the evaporating curve for the cooling fluid in the low temperature region. In FIG. 10, the abscissa denotes a heat exchanging amount Q and the ordinate denotes a temperature T(° C.), wherein the line C denotes an evaporating curve for the second low pressure multi-component refrigerant in the present invention having the configuration shown in FIG. 3, the line D denotes a combined evaporating curve for the low pressure multi-component refrigerant in the low temperature region in the comparison example 3 of the configuration shown in FIG. 8 (an evaporating curve in the flow passage H+an evaporating curve in the flow passage J). Since the line C indicates the lower evaporating temperature by about 2° C. as compared with the line D over the long temperature region, resulting in that a logarithm average temperature difference with the fluid to be cooled can be set large and a heat transfer area of the heat exchanger can be reduced.

Figure 5:
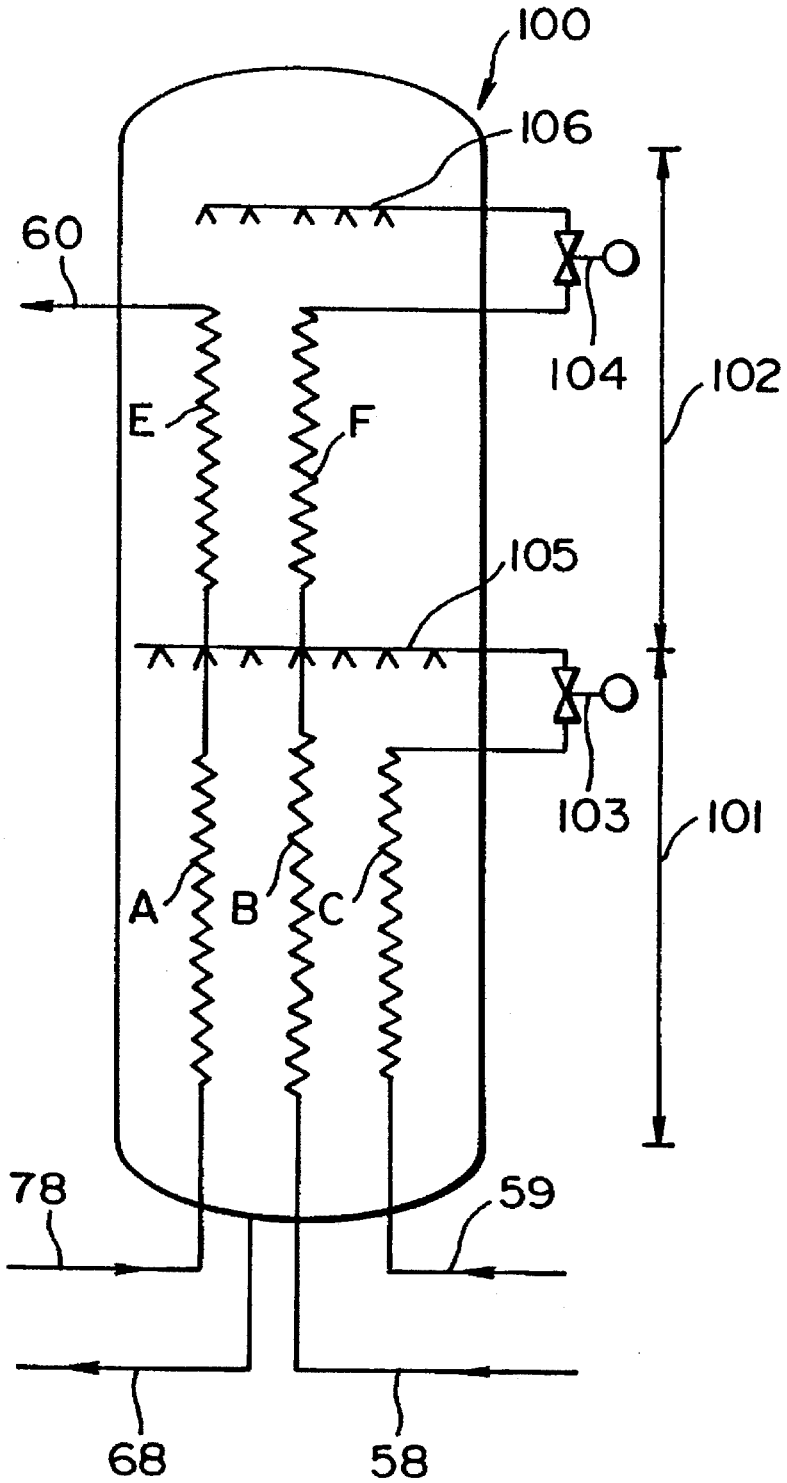
FIG. 5 PRIOR ART
FIG. 5 is a view for illustrating a constitution of a gas liquefying method using the prior art Hampson type heat exchanger.
Figure 11:
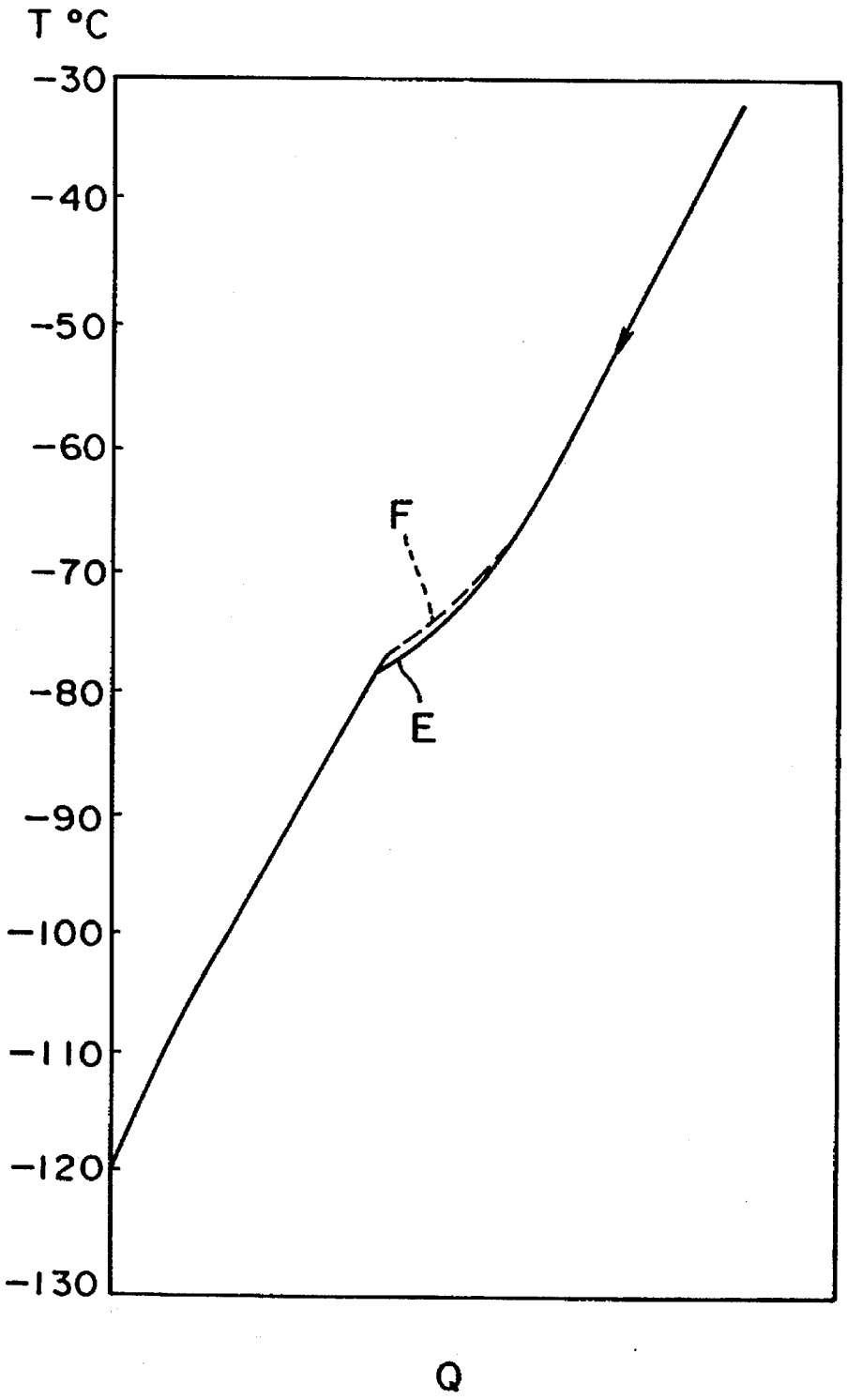
FIG. 11 is a view for showing a relation between the heat exchanging amount Q and the temperature T in one case in which the plate-fin type heat exchanger is applied as a heat exchanger and the other case in which the Hampson type heat exchanger is applied in the process shown in FIG. 3, respectively.

As for the process using the plate-fin type heat exchanger shown in FIG. 3 (the present invention) and, the process shown in FIG. 3 (a comparison example 4) which only the heat exchanger 70 is replaced to the Hampson type heat exchanger shown in FIG. 5, a relation between a heat exchanging amount Q and a temperature T in the case of manufacturing LNG indicated in Table 1 from the raw material gas shown in Table 1 is indicated in FIG. 11. In addition, a result of calculation in which a consumption power of the compressor in the present invention is calculated is indicated in Table 2. Also in the comparison example 4 (FIG. 5), after the raw gas flow 78 passed through the high temperature region was expanded in the same manner as that of the present invention, the raw gas flow was fed into the low temperature region. LNG product can be obtained by extracting the liquefied gas 10 from the low temperature region of the heat exchanger and expanding it (not shown).

TABLE 1

| Raw Material Gas | | LNG Product | |
|---|---|---|---|
| Supplying pressure: | 49.9 barA | Pressure: | 1 atm |
| Supplying temperature: | 21° C. | Temperature: | −162° C. |
| Supplying flow rate: | 19685 kg · mol/h | Product volume: | 326 ton/h |
| Composition | mol % | Composition | mol % |
| $N_2$ | 0.42 | $N_2$ | 0.444 |
| C1 | 88.70 | C1 | 91.974 |
| C2 | 5.22 | C2 | 5.203 |
| C3 | 3.56 | C3 | 2.077 |
| iC4 | 0.80 | iC4 | 0.205 |
| nC4 | 0.73 | nC4 | 0.095 |
| iC5 | 0.24 | | |
| nC5 | 0.13 | | |
| | | C5+ | 0.002 |
| C6+ | 0.20 | | |

TABLE 2

| | | Present Invention |
|---|---|---|
| Pressure in the gas-liquid separator 73 | barA | 48.0 |
| Gas temperatre at the outlet of the high temperature region | °C. | −124 |
| Gas pressure after passing through the high temperature region and expansion | barA | 10.0 |

TABLE 2-continued

| | | Present Invention |
|---|---|---|
| Liquid temperature at the outlet port of the low temperature region | °C. | −162 |
| High pressure vapour flow temperature of multi-component refrigerant after its liquefaction and expansion | °C. | −168 |
| Flow rate of multi-component refrigerant | kg · mol/h | 31300 |
| Compositiion of multi-component refrigerant $N_2$:C1:C2:C3 | mol % | 11:37:41:11 |
| Flow rate of single component refrigerant (propane) | kg · mol/h | 30941 |
| Compressor power | | |
| For a single component refrigerant | MW | 37.0 |
| For multi-component refrigerant | MW | 70.4 |
| Total | MW | 107.4 |

In FIG. 11, the abscissa denotes the heat exchanging amount Q, the ordinate denotes the temperature T(° C.), the line E (a solid line) denotes a condensing curve for the fluid to be cooled in the comparison example 4 and the line F (a dotted line) denotes a condensing curve for the fluid to be cooled in the present invention. The line F (a dotted line) partially exceeds the line E (a solid line), i.e. the condensing curve for the fluid to be cooled is transferred toward the high temperature side, so that it is possible to reduce the heat transfer area of the heat exchanger, or to reduce a load of a compressor if the heat exchanger is designed in reference to the same degree of temperature difference as that of the Hampson type heat exchanger. A degree of reduction in a load of the compressor is about several MW in the case of the compressor power shown in Table 2.

The present invention can be performed in many other forms without departing from its spirit or its major features. Due to this fact, the aforesaid preferred embodiment is merely an illustrative example in view of all points and it must not be interpreted as a limited one. A scope of the present invention is indicated in the claims and is not restricted by the text of the specification. All the modifications or variations belonging to the equivalent scope of the claims are within the scope of the present invention.

What is claimed is:

1. A gas liquefying method which is carried out by a plate-fin type heat exchanger having a high temperature region having at least four kinds of flow passages at the upper side and a low temperature region having at least three kinds of flow passages at the lower side mounted in such a way that one preferable plate surface may be stood upright comprising the steps of:

separating the high pressure multi-component refrigerant partially condensed through a heat exchanging with the single component refrigerant into the high pressure vapour flow and the high pressure condensed liquid flow;

gas and liquid separating the high pressure vapour flow of the multi-component refrigerant liquefied and extracted from the lower part of the low temperature region into the vapour part and the liquid part got through expansion, mixing the separated vapour part with the liquid part to obtain the second low pressure multi-component refrigerant flow;

mixing the second low pressure multi-component refrigerant flow extracted from the upper part of said low temperature region with the flow got through expansion of the high pressure condensed liquid flow of the multi-component refrigerant after passing through the high temperature region so as to separate gas and liquid, mixing the separated vapour part and liquid part to each other to get the first low pressure multi-component refrigerant flow;

compressing the first low pressure multi-component refrigerant flow extracted as vapour from the upper part of said high temperature region so as to get said partial condensed high pressure multi-component refrigerant;

feeding each of the gas flow, the high pressure vapour flow of the multi-component refrigerant and the high pressure condensed liquid flow of the multi-component refrigerant from the upper parts of three kinds of flow passages in the flow passages in said high temperature region, feeding the first low pressure multi-component refrigerant flow from the lower part of one kind of flow passage in the passages of said high temperature region, heat exchanging the gas flow, the high pressure vapour flow of the multi-component refrigerant and the high pressure condensed liquid flow of the multi-component refrigerant with the first low pressure multi-component refrigerant flow so as to cool them;

feeding each of the gas flow cooled at said high temperature region and the high pressure vapour flow of the multi-component refrigerant from each of the two kinds of flow passages in the flow passages of said low temperature region, feeding the second low pressure multi-component refrigerant flow from the lower part of one kind of flow passage in the flow passages of the low temperature region, and heat exchanging the gas flow and the high pressure vapour flow of the multi-component refrigerant with the second low pressure multi-component refrigerant flow so as to perform a further cooling operation; and extracting the liquefied gas flow from the lower part of said low temperature region and recovering it.

2. A gas liquefying method according to claim 1 further comprising the step of feeding the gas flow having the high boiling component removed from the extracting location to the upper part in other flow passage in the high temperature region after the gas flow fed from one upper part in the flow passage of the high temperature region of said plate-fin type heat exchanger and cooled is extracted from said high temperature region and the high boiling point component is separated and removed.

3. A gas liquefying method according to claim 1 in which the step of making the second low pressure multi-component refrigerant flow is comprised of gas-liquid separating the vapour part and the liquid part obtained by expanding the high pressure vapour flow of the liquefied multi-component refrigerant extracted from the lower part of the low temperature region and mixing of the separated vapour part and the liquid part just before feeding them into the low temperature region.

4. A gas liquefying method according to claim 1 in which the step of making the first low pressure multi-component refrigerant flow is comprised of mixing the second low pressure multi-component refrigerant flow extracted from the upper part of said low temperature region with the flow obtained by expanding the high pressure condensed liquid flow after passing through the high temperature region, gas-liquid separating the refrigerant, and mixing the separated vapour part and condensed part just before they are fed into the high temperature region.

5. A gas liquefying method according to claim 1 further comprised of expanding the gas flow passed through the flow passage in the high temperature region of the plate-fin type heat exchanger before feeding it from the upper part of the flow passage in the low temperature region.

6. A gas liquefying method according to claim 1 in which the step of making partially condensed high pressure multi-component refrigerant is comprised of cooling the first low pressure multi-component refrigerant flow extracted from the upper part of said high temperature region as vapour with non-hydro carbon refrigerant after compression and heat exchanging with single component refrigerant.

7. A gas liquefying method according to claim 1 in which said multi-component refrigerant is mixture of nitrogen and component selected from hydro carbons with number of carbons of 1 to 5.

8. A gas liquefying method according to claim 7 in which said multi-component refrigerant is a mixture composed of nitrogen, methane, ethane and propane.

9. A gas liquefying method according to claim 1 in which said single component is propane.

* * * * *